US007021219B1

(12) United States Patent
Dindl

(10) Patent No.: US 7,021,219 B1
(45) Date of Patent: Apr. 4, 2006

(54) NON-LETHAL TELESCOPING CARTRIDGE

(75) Inventor: Frank J. Dindl, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 423 days.

(21) Appl. No.: 10/709,011

(22) Filed: Apr. 7, 2004

Related U.S. Application Data

(60) Provisional application No. 60/533,518, filed on Jan. 2, 2004.

(51) Int. Cl.
*F42B 10/00* (2006.01)
*F42B 8/00* (2006.01)

(52) U.S. Cl. ..... 102/447; 102/470; 102/502

(58) Field of Classification Search ..... 102/444–447, 102/470, 434, 502
See application file for complete search history.

(56) References Cited

U.S. PATENT DOCUMENTS 6,178,889 B1 * 1/2001 Dindl ..... 102/447
6,324,983 B1 * 12/2001 Dindl ..... 102/447
6,324,984 B1 * 12/2001 Dindl ..... 102/447

* cited by examiner

*Primary Examiner*—Harvey E. Behrend
(74) *Attorney, Agent, or Firm*—Michael C. Sachs; John F. Moran

(57) ABSTRACT

A low-impulse, non-lethal telescoping cartridge for deployment of non-lethal ordnance. The cartridge includes a payload cup containing at least one non-lethal projectile. The payload cup is telescopically mounted upon a cartridge case base. When fired, the payload cup telescopes out from the base and releases the non-lethal projectiles at a non-lethal velocity. The telescoping feature of the cartridge allows the cartridge to be fired from an automatic weapon, such as a 40 mm MK19 grenade machine gun.

13 Claims, 5 Drawing Sheets

NON-LETHAL TELESCOPING CARTRIDGE

CROSS REFERENCE TO RELATED APPLICATIONS

This application claims the benefit under 35 USC 119(e) of U.S. provisional patent application 60/533,518 filed Jan. 2, 2004, the entire file wrapper contents of which are herein incorporated by reference as though fully set forth at length.

FEDERAL RESEARCH STATEMENT

The inventions described herein may be made, used, or licensed by or for the U.S. Government for U.S. Government purposes.

BACKGROUND OF INVENTION

The present invention relates to a non-lethal telescoping cartridge for deployment of non-lethal ordnance. In particular, a low impulse non-lethal telescoping cartridge is disclosed, having a payload cup containing non-lethal projectiles, telescopically mounted upon a cartridge case base which, when fired, telescopes out from the base and releases the non-lethal projectiles at a non-lethal velocity. The cartridge of the present invention may be fired from an automatic weapon, such as a 40 mm MK19 grenade machine gun.

Traditional non-lethal ordnance comprises cartridges that contain, for example, projectiles consisting of metal balls coated with a thin layer of plastic or rubber, fabric bags which are filled with lead shot (so-called "bean bags"), and "rubber bullets" formed of hard rubber, foam, plastic or wood. These traditional non-lethal projectiles have various problems, such as a short range, poor accuracy and possible lethality.

For example, non-lethal projectiles are generally aerodynamically unstable due to the shape needed for non-lethality (generally approximately round, such as rubber bullets, or amorphous, such as a bean-bag). As such, the aerodynamic forces exhibited by these projectiles tend to vary and be inconsistent, which leads to poor accuracy. In the case of a bean-bag projectile, the projectile tends to flatten out in flight, forming a flat high-drag flight surface. Furthermore, non-lethal projectiles are generally launched from smooth bored guns which, unlike rifled bores, do not impart spin to the projectile and, as a result, decrease accuracy.

To overcome the accuracy problems discussed above, spin-stabilized non-lethal projectiles have been proposed, such as disclosed in U.S. Pat. No. 6,041,712 to Lyon. However, various difficulties remain in the use of such devices. For example, when desiring to use non-lethal cartridges in automatic weapons such as the 40 mm MK19 grenade machine gun, the ammunition must produce sufficient blowback (i.e., energy transferred to the bolt) to recycle the weapon, and must accurately conform to the chamber dimensions of the weapon so as to avoid jamming of the weapon.

An automatic weapon such as the 40 mm MK 19 grenade machine gun is actuated by the direct blowback of the cartridge case against the bolt upon expansion of the propellant gas during the time between cartridge ignition and projectile exit from the barrel. The MK19 is designed to function when firing 40 mm cartridges with a cartridge impulse of approximately 13 to 15 pounds-seconds. Reduced cartridge impulses provided by lower mass projectiles (such as blanks, training cartridges and non-lethal cartridges) and/or reduced chamber pressure results in reduced energy transferred to the bolt. Consequently, the weapon cyclic rate, and potentially the ability of the cartridge to recycle the weapon at all, may be in question.

U.S. Pat. Nos. 6,178,889, 6,324,983 and 6,324,984 disclose a low impulse telescoping cartridge, a sub-caliber projectile for low impulse cartridges, and a payload mechanism for low impulse cartridges, respectively. The present invention differs from these disclosures in several respects.

For example, in the present invention, a step is provided on the cartridge case forward of the rim, to improve the interface with the MK19 bolt face and improve weapon functional reliability when firing low impulse telescoping cartridges. The present invention further provides a rifled payload cup for launching spin stabilized projectiles from smooth bore weapons and from rifled weapons where use of the weapon rifling is not desired or practical. In addition, an end cap is provided which snaps over the end of the payload cup or body to close the end of the payload cup and retain the payload within the payload cup until the moment of firing.

The present invention also provides a high/low adapter in the cartridge case which vents thru the side of the brass case containing the propellant charge, effectively using the brass case as a rupture membrane to assure that sufficient gas pressure is produced to provide consistent propellant burning. The high/low adapter in the cartridge also contains a forward vent hole and a pocket for retaining a firing pin for initiating the primer in the base of the high/low adapter in the payload cup.

One embodiment of the high/low adapter in the payload cup uses a pistol caliber brass case and pistol primer. A cover that attaches to the base of the pistol case serves as a retainer for the primer to ensure that the primer does not blow out of the brass case. Another embodiment of the high/low adapter in the payload cup uses a rifle caliber brass case.

A spring in the form of a hollow cylinder is used inside the cartridge to maintain the position of the payload cup relative to the cartridge case during chambering and firing. The spring is made of, for example, a polymer. The spring helps to ensure that the payload cup is against the forward stop at the moment of firing.

In contrast, the '983 patent, although disclosing a telescoping cartridge, utilizes a smoothbore sub-caliber payload cavity which is used with a sub-caliber rifled barrel insert when launching spin stabilized projectiles. The present invention provides for rifling the payload cavity for launching sub-caliber spin stabilized projectiles, thus eliminating the need to use a sub-caliber barrel insert.

The present invention improves upon the prior art through, among other features, the use of 1) a step on the case forward of the rim to improve the interface with the MK19 bolt face to improve the weapon functional reliability, 2) a rifled payload cup for launching spin stabilized projectiles, 3) an end cap that snaps over the end of the payload cup or body to close the end of the payload cup and retain the payload within the payload cup until the moment of firing, 4) a rear high/low adapter which has one or more holes thru the side thereof to allow venting directly thru the side of the brass case, eliminating the need for a separate rupture disk to control the propellant ignition, 5) provision of a firing pin and firing pin cavity in the forward end of the rear high/low adapter for initiating the forward high/low adapter in the payload cup, 6) a retaining cover for holding the primer in the base of the brass case in the forward high/low adapter in the payload cup, and 7) a spring used inside the cartridge case to maintain the position of the payload cup relative to the cartridge case during chambering and firing.

It is a first object of the present invention to provide a low impulse non-lethal cartridge for use in conventional automatic weapons, such as the 40 mm MK19 grenade machine gun.

It is a second object of the present invention to provide non-lethal ammunition capable of accelerating a bolt to the rear of the weapons chamber independently of the impulse generated from launching of the non-lethal projectile.

It is a third object of the present invention to provide a non-lethal cartridge for use in conventional automatic weapons, such as the MK19 grenade machine gun, which do not necessitate changes to the weapon itself in order to utilize the ammunition, but which also allow effective and accurate firing of the reduced velocity and/or reduced mass (non-lethal) projectiles.

It is a fourth object of the present invention to provide an ammunition configuration which allows for reliable loading and firing of the ammunition in conventional automatic weapons, such as the MK 19 grenade machine gun.

It is a fifth object of the present invention to provide an ammunition configuration having high/low propellant chambers which allow for consistent propellant burn, and which provide consistent interior ballistics, while avoiding lethal propellant projectile characteristics.

The invention will be better understood, and further objects, features, and advantages thereof will become more apparent from the following description of the preferred embodiments, taken in conjunction with the accompanying drawings.

BRIEF DESCRIPTION OF DRAWINGS

In the drawings, which are not necessarily to scale, like or corresponding parts are denoted by like or corresponding reference numerals.

DETAILED DESCRIPTION

Figure 1:
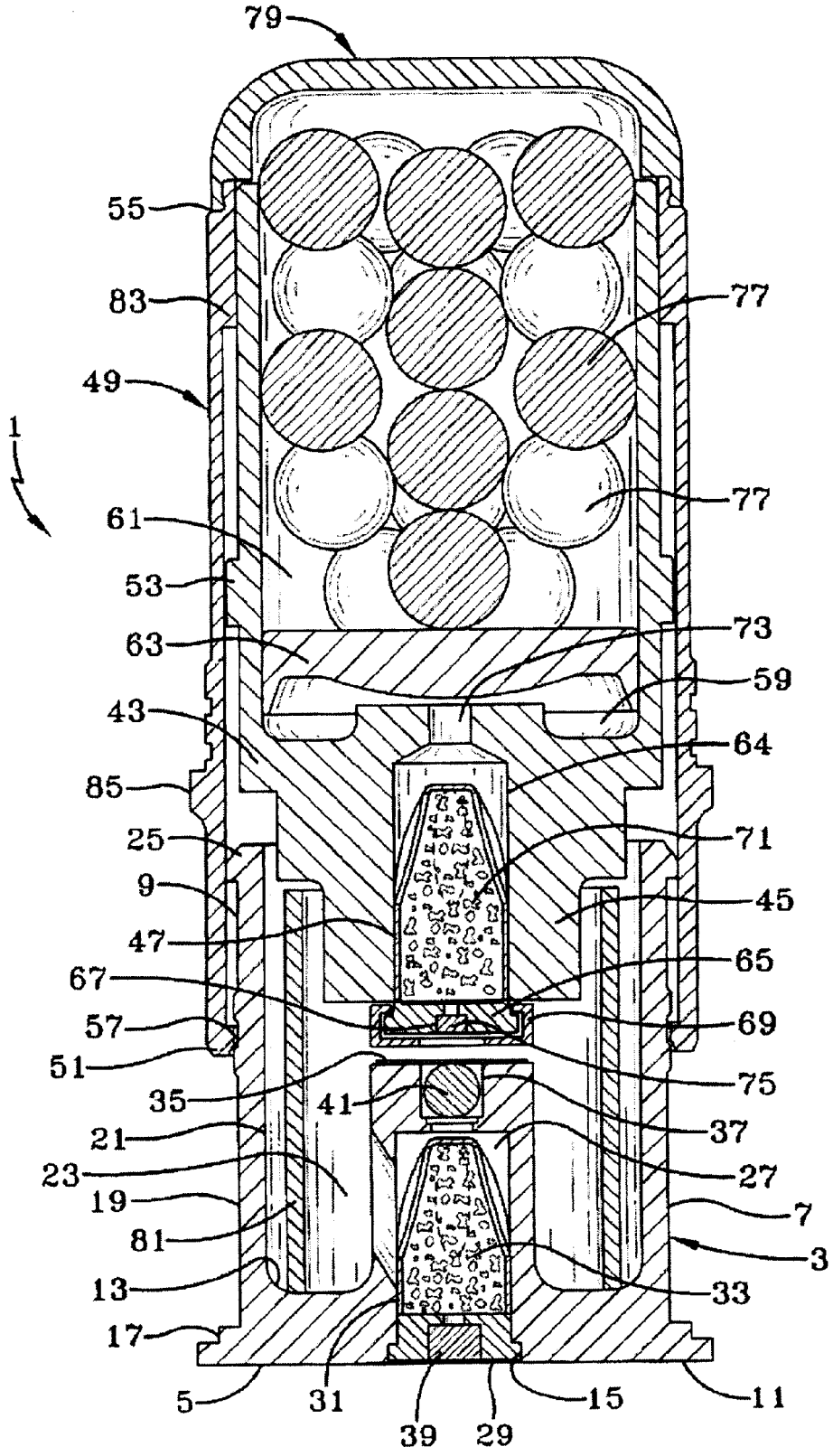
FIG. 1 is a cross sectional side view of the non-lethal telescoping cartridge of the present invention.
Figure 2:
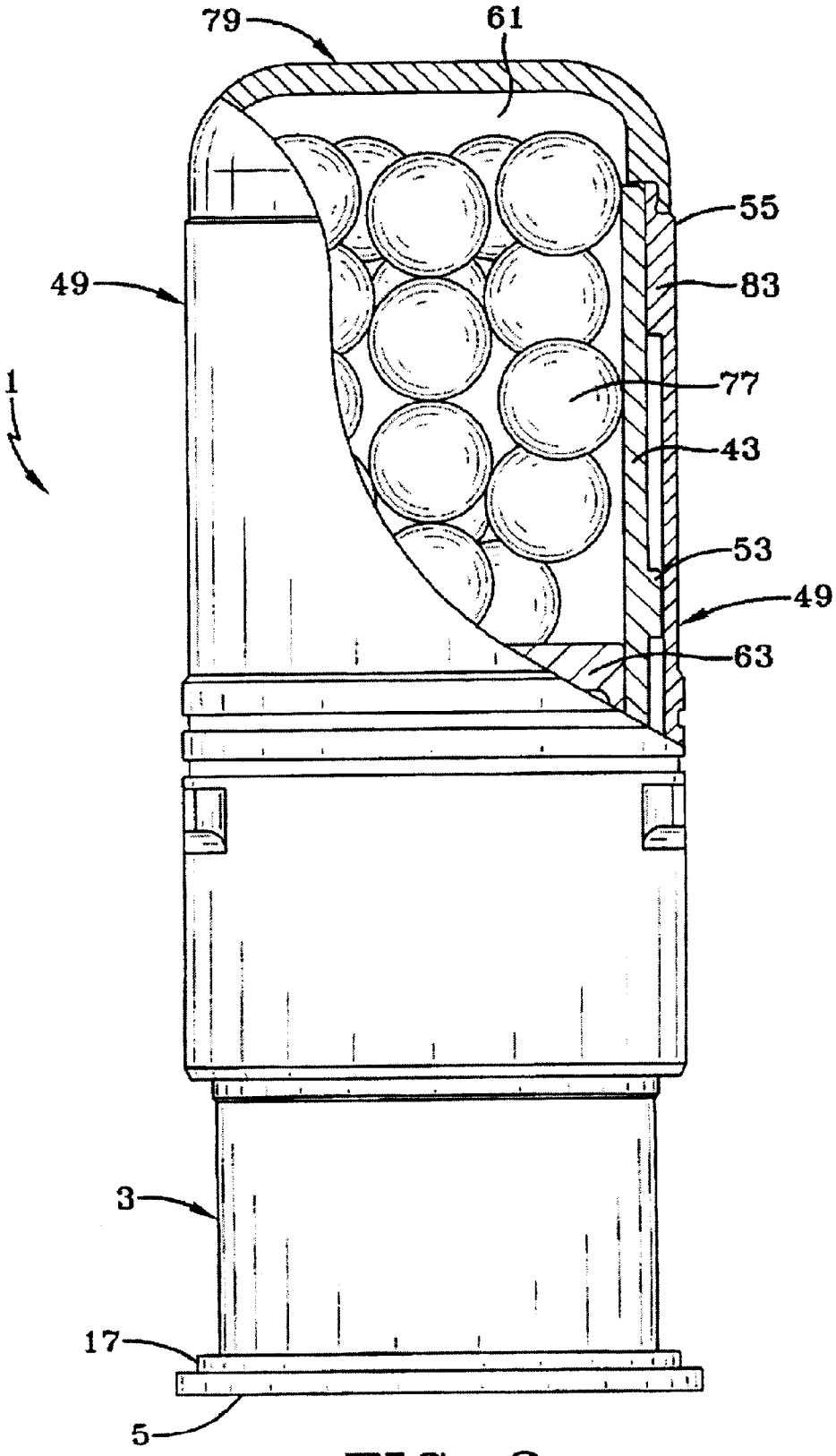
FIG. 2 is a side view of the non-lethal telescoping cartridge of the present invention with a portion of the payload cup and end cap cut away, illustrating the disposition of the non-lethal projectiles therein.

As illustrated in FIGS. 1 and 2, a non-lethal telescoping cartridge 1 is provided comprising a cartridge case 3. The cartridge case 3 is comprised of a base 5, a circumferential portion 7 and a forward end 9. The base 5 has an exterior 11 and interior 13, said exterior 11 having a cartridge case aperture 15 formed there through and a step 17 formed adjacent the circumferential portion 7. The circumferential portion 7 has an exterior portion 19 and an interior portion 21, the interior portion 21 defining a rear low pressure chamber 23.

The forward end 9 of the cartridge case 3 has a cartridge case ridge 25 formed thereon. A rear high/low pressure chamber 27 is disposed through the cartridge case aperture 15 and within the rear low pressure chamber 23. The rear high/low pressure chamber 27 has a base end 29, a circumferential portion 31 defining a powder containment area 33, and a forward end 35 having a firing pin chamber 37 formed therein.

A first primer 39 is disposed within the base end 29 of the rear high/low pressure chamber 27. A firing pin 41 is disposed within the firing pin chamber 37. A payload cup 43 is movably disposed adjacent the forward end 9 of the cartridge case 3. The payload cup 43 includes a base 45 defining a payload cup base aperture 47. A payload support wall 63 is disposed between a forward low pressure chamber 59 and a payload containment area 61. A payload cup boss 53 is formed on the exterior surface of the payload cup 43 and contacts the interior surface of the cartridge body 49.

A cartridge body 49 includes a rear edge 51 and a forward edge 55. The rear edge 51 of the cartridge body 49 has a ridge 57 formed thereon. Forward movement of the cartridge body 49 relative to the cartridge case 3 is limited by the engagement of ridge 57 on the body 49 with ridge 25 on the case 3. Forward edge 55 of the cartridge body 49 has a step 83 formed thereon. Step 83 limits the forward movement of the cup 43 relative to the cartridge body 49 by engaging payload cup boss 53.

A forward high/low pressure chamber 64 is disposed in the payload cup base aperture 47. The forward high/low pressure chamber 64 is positioned between the forward end 35 of the rear high/low pressure chamber 27 and the payload support wall 63. The forward high/low pressure chamber 64 includes a base end 65 with a primer cup 67, a powder containment area 71 and a forward end 73 adjacent the payload support wall 63.

A second primer 75 is disposed within primer cup 67 located in the base end 65 of the forward high/low pressure chamber 64. A primer retainer 69 is disposed around the base end 65 of the forward high/low pressure chamber 63 to retain the second primer 75. The primer retainer 69 slips over the base end 65 of the brass case of the forward high/low pressure chamber 64 and prevents the second primer 75 from blowing out of the forward high/low pressure chamber firing. Usually, primers located on the base of the cartridge case are supported by the bolt face or breach face. However, in a telescoping cartridge such as provided herein, there is no contact/support of the second primer 75 located on the base of the payload cup 43.

One or more non-lethal projectiles 77 are disposed within the payload containment area 61. An end cap 79 is removably disposed upon the forward edge 55 of the cartridge body 49. A spring 81 is disposed between the payload cup base 45 and the interior portion 13 of the base 5 of the cartridge case 3. Spring 81 allows the payload cup 43 to move relative to the cartridge case 3. As shown in FIG. 1, spring 81 is in the form of a hollow cylinder, preferably made of a polymer.

The circumferential portion 7 of the case 3 of the non-lethal telescoping cartridge 1 of the present invention has an outer diameter slightly smaller than that of traditional 40 mm ammunition. As such, when the cartridge 1 is loaded and fired through an automatic weapon using 40 mm ammunition, such as the MK 19 grenade machine gun, the ammunition tends to rotate in the chamber as it passes through the weapon during firing. This leads to jamming of the ammunition in the weapon, a potentially catastrophic occurrence during battle.

To overcome this problem, the present invention includes a step 17 at the base 5 adjacent the circumferential portion 7. Step 17 provides an interface for the bolt fingers on automatic weapons, such as the MK 19 grenade machine gun. Step 17 prevents the cartridge from rotating as it passes down the bolt face of the weapon, to prevent jamming of the ammunition in the weapon. Step 17 causes the weapon to interpret the non-lethal telescoping cartridge 1 of the present invention as having the same diameter as standard 40 mm ammunition.

Figure 4:
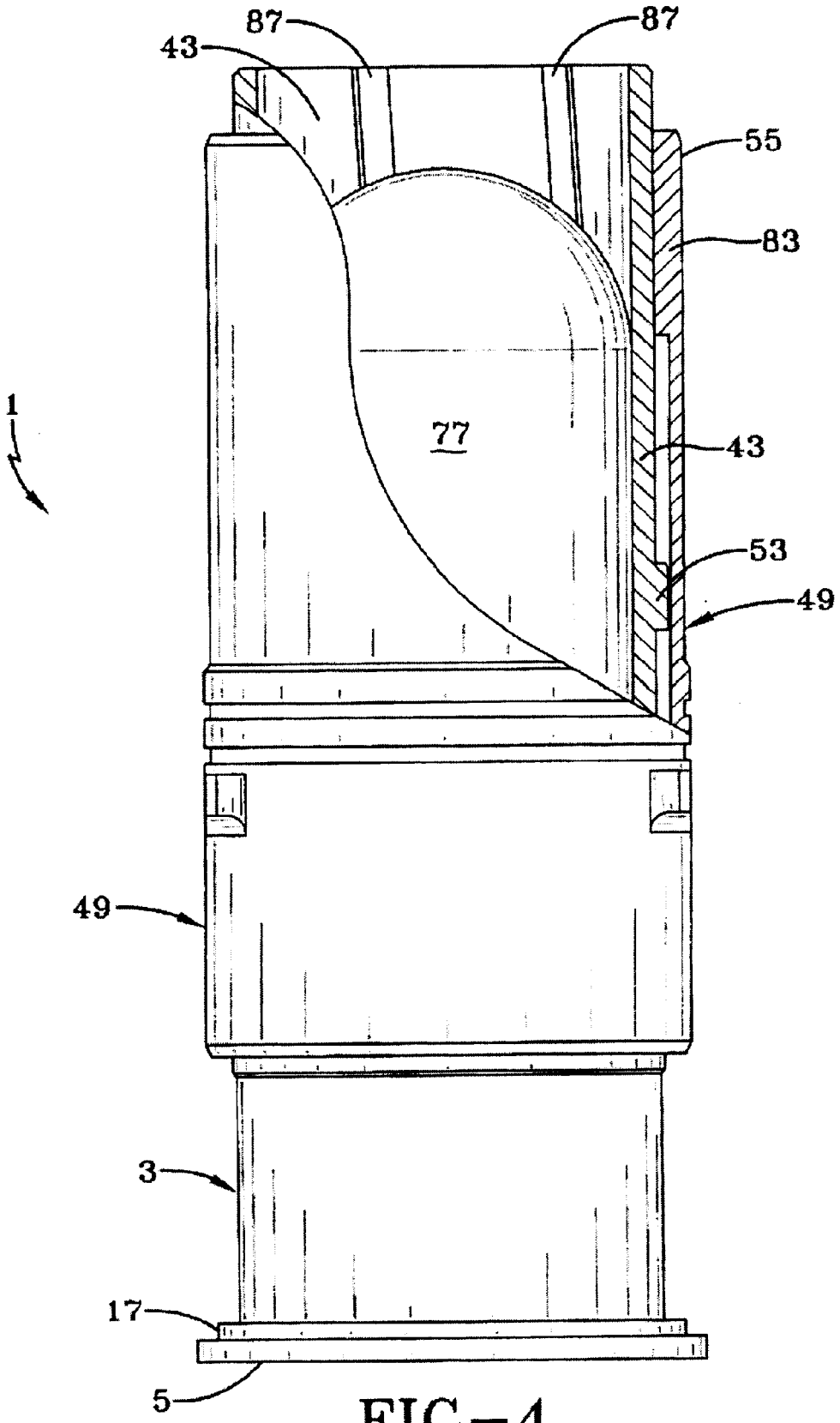
FIG. 4 is a side view, partially cut away, of the payload cup of the non-lethal telescoping cartridge of the present invention, illustrating the rifled inner portion of the circumferential portion of the payload cup, and an embodiment comprising a single, large non-lethal projectile.

As shown in FIG. 4, the inner surface of the payload cup 43 adjacent the payload containment area 61 may be rifled. Rifling 87 of the inner surface allows firing of low drag, spin stabilized projectiles, providing greater effective range. To obtain an effective range in the absence of rifling, another form of projectile stabilization may be needed, such as fin-stabilization or drag-stabilization.

Figure 3:
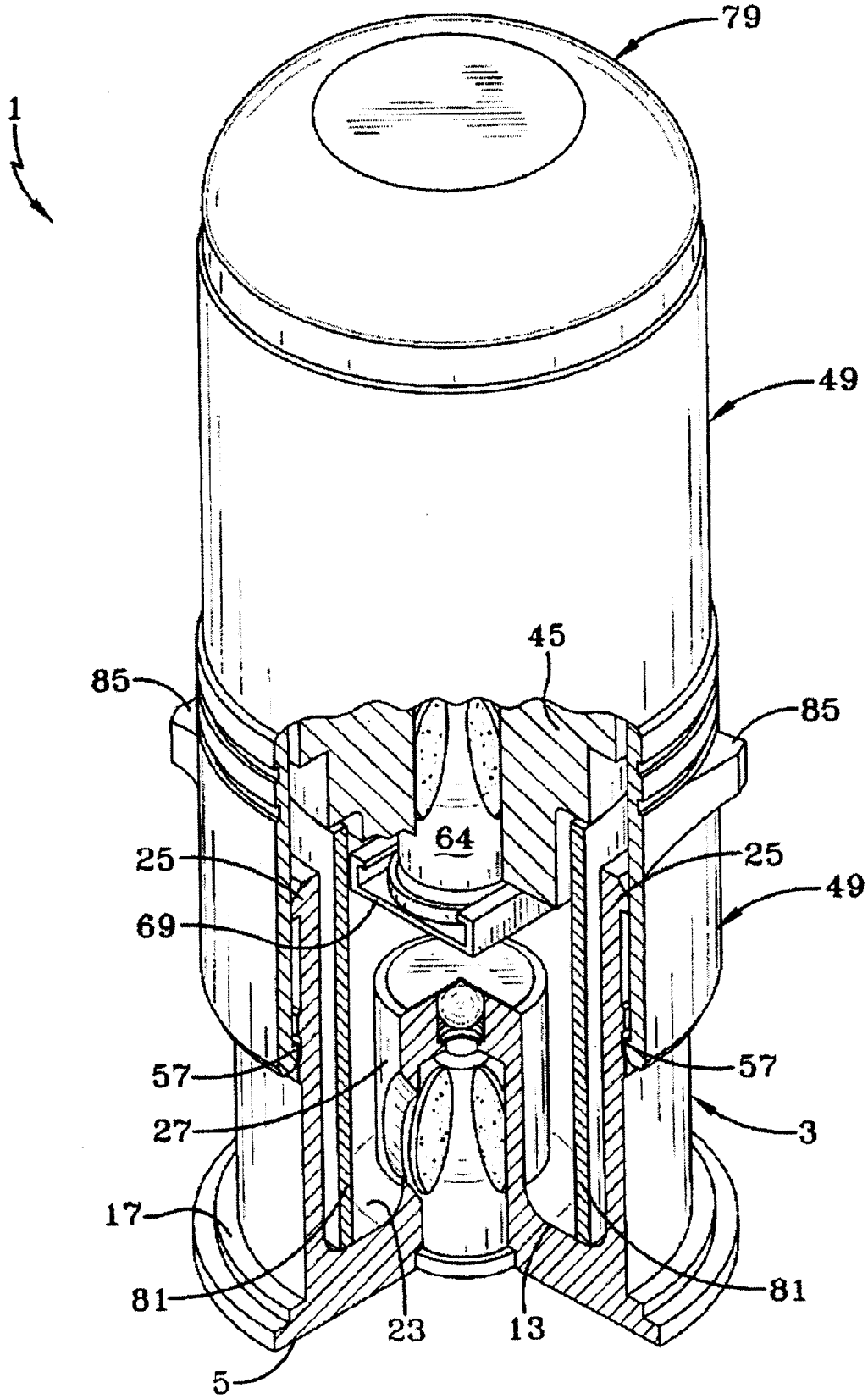
FIG. 3 is a perspective view, partially cut away, of the non-lethal telescoping cartridge of the present invention, illustrating the disposition of the rear and forward high/low chambers.

As shown in FIG. 3, a known shoulder 85 may be formed on the exterior surface of the cartridge body 49. Shoulder 85 prevents sliding of the cartridge body 49 relative to the barrel when loading the non-lethal telescoping cartridge 1 into a weapon. Shoulder 85 receives a link (not shown) from an ammunition belt.

Spring 81 is disposed in the rear low chamber 23 between the payload cup base 45 and the interior portion 13 of the base 5 of the cartridge case 3. Spring 81 serves as a linkage between the cartridge case 3 and the payload cup 43. Spring 81 is a compression spring and provides a force to ensure that boss 53 of payload cup 43 is up against the cartridge body step 83 at the moment of firing. Spring 81 may be comprised of any elastic material. Preferably, a polymer or polyurethane sleeve is used. Alternatively, a metallic spring may be used. The spring 81 must have an elastic characteristic sufficient to allow easy contraction/movement of the payload cup 43 relative to the cartridge case 3 when loading the cartridge 1 into a weapon.

Figure 5:
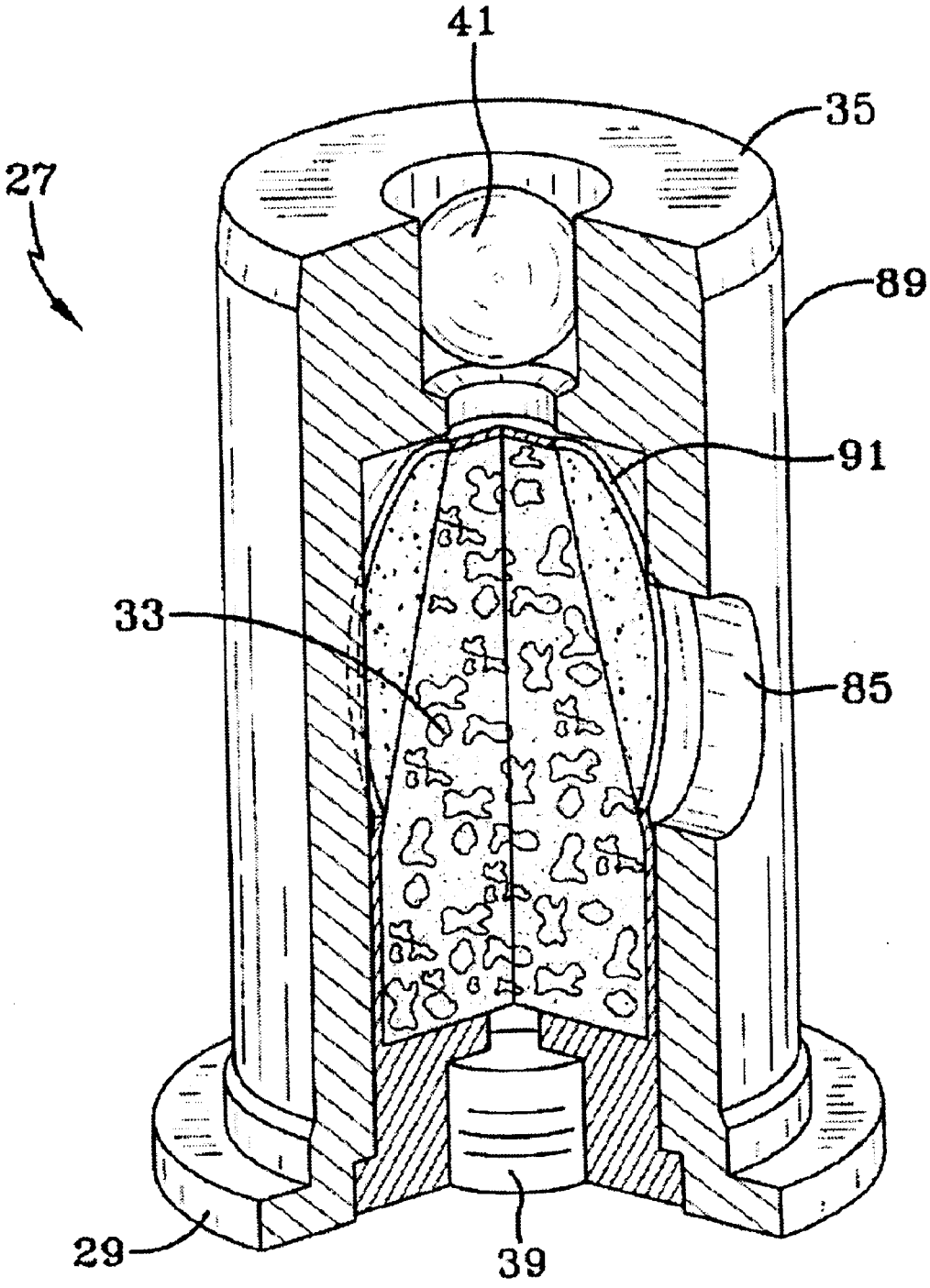
FIG. 5 is a perspective view of the rear high/low chamber of the non-lethal telescoping cartridge of the present invention, illustrating the pressure relief hole.

As illustrated in FIG. 5, the rear high/low pressure chamber 27 may have a pressure relief hole 85 formed therein for venting propellant gases into the rear low pressure chamber 23. A high low adapter comprises a sleeve 89 that retains a brass case 91, the brass case 91 defining the rear high/low chamber. The pressure relief hole 85 is formed in the sleeve 89. When the pressure within rear high/low chamber 27 reaches a predefined pressure, such as within 2000–5000 psi, the brass case 91 defining the rear high/low pressure chamber 27 bursts, and the propellant gas therein is vented into the low pressure chamber via the pressure relief hole 85. By forming the pressure relief hole 85 in the sleeve 89, the propellant consistently burns, and the peak pressure is limited to a practical level.

Conventionally, simple burst discs, usually made out of brass, are used to seal the vents leading from, for example, a rear high/low pressure chamber. However, by using a separate component such as a burst disc, assembly is more difficult and expensive. In addition, if during assembly the burst disc is accidentally omitted, propellant may fall into the low pressure chamber, causing the propellant to not burn properly and/or lowering the energy delivered to the bolt, which may cause the weapon to stop firing.

In a further embodiment of the present invention, the rear high/low pressure chamber 27 may be tapered from the base end 29 to the forward end 35 thereof. Practically, the outside of the sleeve 89 forming the rear high/low adapter 27 is tapered to make it easier to assemble, i.e., to insert the sleeve 89 into the cartridge case. If the sleeve 89 is fabricated separately from the cartridge case 3, and inserted therein, and if the sleeve 89 has one continuous diameter, upon insertion into the cartridge case 3, the sleeve 89 tends to scrape against the cartridge case 3, allowing excess scrapings to build up within and around the interface of the sleeve 89 and the cartridge case 3. This causes possible problems with seating of the sleeve 89 within the cartridge case, and possible contamination of the weapons system with fragments.

With regard to the payload cup firing pin 41, various configurations may be utilized, such as a spherical BB, a cylinder, or a firing pin tip on a cylindrical body. The provision of a separate payload cup firing pin 41 ensures positive ignition of the second primer 75. Propellant gas produced in the rear high/low chamber 27 propels the payload cup firing pin 41 into the second primer 75 upon firing. This allows very reliable ignition of the second primer 75, and the payload propellant.

In an alternative embodiment, propellant gases formed in the rear high/low chamber 27 may be allowed to directly impinge on the second primer 75, without the use of a payload cup firing pin. In a further alternative embodiment, a rupture disc may be disposed within the top of the rear high/low chamber 27, which replaces the firing pin 41 (i.e., acts to initiate primer), and which also allows the propellant gases to vent from the rear high/low chamber. In such an embodiment, the pressure relief hole 85 need not be formed in the sleeve.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A non-lethal telescoping cartridge comprising:

a cartridge case having a base, a circumferential portion and a forward end, the base having an aperture therethrough and a step formed adjacent the circumferential portion, the circumferential portion defining a rear low pressure chamber, the forward end having a cartridge case ridge formed therein;

a rear high/low pressure chamber disposed in the cartridge case aperture and within the rear low pressure chamber, the rear high/low pressure chamber having a base end, a circumferential portion defining a powder containment area, and a forward end having a firing pin chamber formed therein;

a cartridge body slidingly engaged on the cartridge case, the cartridge body including a ridge formed on a rear end thereof, the ridge of the cartridge body cooperating with the ridge of the cartridge case to limit relative movement of the cartridge body and the cartridge case, the cartridge body including a step formed on a forward end thereof;

a payload cup movably disposed adjacent the forward end of the cartridge case and inside the cartridge body, the payload cup having a base defining a forward low pressure chamber and a circumferential portion defining a payload containment area, the circumferential portion having a payload cup boss formed thereon, the payload cup boss cooperating with the step on the forward end of the cartridge body to limit relative movement of the payload cup and the cartridge body;

a payload support wall disposed between the forward low pressure chamber and the payload containment area;

a forward high/low pressure chamber disposed between the forward end of the rear high/low pressure chamber and the payload support wall, the forward high/low pressure chamber having a base end defining a primer cup, a circumferential portion defining a powder containment area, and a forward end adjacent the payload support wall;

at least one non-lethal projectile disposed in the payload containment area;

an end cap removably disposed on the forward edge of the cartridge case; and a spring disposed between the payload cup base and the interior portion of the base of the cartridge case.

2. The non-lethal cartridge of claim 1 further comprising rifling formed on an inner surface of the payload cup for launching spin stabilized projectiles.

3. The non-lethal cartridge of claim 1 further comprising a shoulder formed on the exterior of the circumferential portion of the cartridge case to prevent sliding of the payload cup relative to the cartridge case when loading of the cartridge into a weapon.

4. The non-lethal cartridge of claim 1 wherein the spring comprises a hollow cylinder.

5. The non-lethal cartridge of claim 1 wherein the spring is made of a polymer.

6. The non-lethal cartridge of claim 1 wherein the rear high/low pressure chamber has a pressure relief hole formed therein for venting propellant gases into the rear low pressure chamber.

7. The non-lethal cartridge of claim 1 wherein the rear high/low pressure chamber is tapered from the base end to the forward end thereof.

8. The non-lethal cartridge of claim 1 further comprising a primer disposed within the base end of the rear high/low pressure chamber.

9. The non-lethal cartridge of claim 1 further comprising a firing pin disposed within the firing pin chamber.

10. The non-lethal cartridge of claim 1 further comprising a primer disposed within the primer cup located in the base end of the forward high/low pressure chamber.

11. The non-lethal cartridge of claim 10 further comprising a primer retainer disposed around the base end of the forward high/low pressure chamber to retain the primer.

12. The non-lethal cartridge of claim 1 wherein the at least one non-lethal projectile comprises a single non-lethal projectile disposed in the payload containment area.

13. The non-lethal cartridge of claim 1 further comprising a plurality of non-lethal projectiles disposed in the payload containment area.

* * * * *